United States Patent [19]

Motz et al.

[11] Patent Number: 4,953,351

[45] Date of Patent: Sep. 4, 1990

[54] COMBUSTION CONTROL

[75] Inventors: Karl Motz, Bergkirchen-Eisolzried; Markus Diehl, Furstenfeldbruck, both of Fed. Rep. of Germany

[73] Assignee: Man Technologie GmbH, Munich, Fed. Rep. of Germany

[21] Appl. No.: 270,087

[22] Filed: Nov. 14, 1988

[30] Foreign Application Priority Data

Nov. 12, 1987 [DE] Fed. Rep. of Germany ..... 3738454
Jul. 2, 1988 [DE] Fed. Rep. of Germany ..... 3822415

[51] Int. Cl.[5] ..... F02D 41/14

[52] U.S. Cl. ..... 60/285; 60/276; 123/440

[58] Field of Search ..... 123/440, 489; 60/276, 60/285

[56] References Cited

U.S. PATENT DOCUMENTS 3,696,618 10/1972 Boyd et al. ..... 123/440 X
3,827,237 8/1974 Linder et al. ..... 60/276 X
4,033,712 7/1977 Morton ..... 123/440 X
4,305,364 12/1981 Stuckas ..... 123/440
4,729,220 3/1988 Terasaka et al. ..... 60/285

FOREIGN PATENT DOCUMENTS 3410930 10/1985 Fed. Rep. of Germany .

*Primary Examiner*—Tony M. Argenbright
*Attorney, Agent, or Firm*—Ladas & Parry

[57] ABSTRACT

A method for controlling the combustion air ratios for IC engines using a three way catalyst. In known systems the control operation has been impaired by several factors, one being the aging of the lambda probe used for control. In order to allow for such factors the set point of the controller is adjusted under certain conditions or at certain intervals. For the adjustment of the set point the increase in the exhaust gas temperature as caused by the exothermic reaction in the catalyst is measured and employed for establishing a new set point.

9 Claims, 5 Drawing Sheets

COMBUSTION CONTROL

BACKGROUND OF THE INVENTION (a) Field of the Invention

The invention relates to a method and apparatus for the automatic control of the air/fuel ratio of a catalyst IC engine using a controller and a lambda probe, which is arranged in the exhaust pipe of the IC engine, the lambda controller also responding to the signals of at least one exhaust gas temperature probe and processing the same to adjust the set point.

(b) Description of Prior Art

The German pre-examination specification No. 3,410,930 describes a device of this type, in which the fuel supply rate to a mixer is controlled by means of a lambda controller dependent on the signals of a lambda probe. The lambda probe produces a signal which is a function of the actual air/fuel ratio (in what follows referred to as the lambda value), for instance by detecting the difference between the $O_2$ partial pressure of the engine exhaust gas and of the ambient air and producing a corresponding electrical output signal. It is known that the characteristic curve of such probes is dependent on the temperature of the exhaust gas to which the probe is exposed. This effect is taken into account in the known device inasmuch as the controller responds to the signals of a temperature sensor arranged in the exhaust gas pipe and processes the signals to effect a temperature compensation of the lambda control function. However it has become clear that the overall system is subject to other effects. If for instance the properties of the lambda probe or the catalyst change owing to age, the set point of the lambda controller will have to be adjusted to achieve operation with optimum contaminant data.

SUMMARY OF THE INVENTION

One object of the present invention is to provide a method which ensures the optimum overall compensation of the factors influencing the control operation.

A still further object of the invention is to achieve this in the simplest possible manner.

In order to achieve these or other objects appearing from the present specification and claims the variation in exhaust gas temperature is sensed at a position after the exhaust gas has undergone catalytic action either within the catalyst or downstream thereof in accordance with the air/fuel ratio and is used for updating the set point.

The set point, which corresponds to the lambda probe potential at the desired lambda value, depends on the characteristic curve of the lambda probe used. In the invention it is only a question of adapting the set point to suit changed system states by measuring and evaluating an exhaust gas temperature and, respectively, catalyst temperature without the need for data regarding the new characteristic curve of the probe.

The method of the invention utilizes an increase of the temperature at the catalyst which is caused by the exothermic reaction events. In fact, it has been found from measurements that there is a fixed relationship between the conversion of contaminants and the temperature variation at the catalyst.

The invention is based on the discovery that on plotting the temperature variations at the catalyst against the lambda values a distinct change in slope will be seen, the bend in such slope being at the maximum contaminant conversion rate of the catalyst. On the basis of this temperature bend point it is then determine sufficiently precisely the lean limit for the lambda window to be set and thus to establish the set point, which results in operation with a good conversion of the contaminants.

The method in accordance with the invention is particularly suitable for IC engine equipment which operates with a constant load, as for instance stationary generator sets and the like. In this case the adjustment of the set point may be undertaken conveniently at any time without then having to modify the operational state of the IC engine.

The invention offers particular advantages in connection with three-way catalysts, in the case of which a satisfactory contaminant conversion is only ensured within a narrow lambda range or lambda window. By periodic adjustment of the set point low-contaminant operation of the plant may be guaranteed.

In the case of systems operating with varying loads the adjustment process has to take place during a preset type of operation, which, as described below, may be monitored by checking the exhaust gas temperature.

The adjustment process is preferably performed by stepwise modification of the set point and subsequent measurement of the temperature at the catalyst. By making a comparison of the temperature with the preceding behinds in the temperature curve may be ascertained in connection with the appropriate set point value. This value for the set point would correspond to the lean limit of the lambda window in the case of a three-way catalyst.

The new set point is preferably taken as this set point which is modified by a fixed amount.

For the adjustment operation it is possible to utilize a reference temperature, as for instance the exhaust gas temperature upstream from the catalyst. In this manner it is possible to detect and take into account any irregularities which influence the overall picture of temperature-related events. In this respect it is possible to omit the adjustment process if an irregularity in the reference temperature is detected, which affects the temperature difference between the temperature measured at the catalyst and the reference temperature. This means that no redetermination of the set point need be performed due to modified general conditions of operation.

The performance of the adjustment process on the basis of the above-mentioned temperature difference offers the further advantage that the detected temperature difference may simultaneously be employed for other monitoring functions, that is to say for monitoring the condition of the catalyst. This temperature difference is affected by the reaction in the catalyst, that is to say in such a manner that there is a decrease in the temperature difference on aging of the catalyst.

The invention furthermore provides an apparatus for performing the method which is characterized in that the controller is fitted with a set point generator, which has one input for the signals from a temperature sensor placed at or downstream from the catalyst, and the set point generator is so designed that it makes it possible for the temperature at or downstream from the catalyst to be sensed and evaluated as a function of the air/fuel ratio of the combusted mixture.

The invetion will now be described in more detail with reference to the working examples diagrammatically shown in the drawing.

DETAILED DESCRIPTION OF THE WORKING EMBODIMENTS OF THE INVENTION

The purpose of lambda control is to so adapt the air/fuel ratio of a catalyst IC engine that there is a minimum emission of contaminants. The emission of $NO_x$ and CO from the catalyst is plotted in the lower part of FIG. 1 against the air/fuel ratio lambda. The oppositely directed course of the two curves ensures that the emission of the two contaminants may be kept below certain predetermined limits A and B, inasmuch as the operational range of the engine is kept within a lambda window 13 as defined by the two limits A and B. In this lambda window there is an operational point at which the two contaminant components CO and $NO_x$ both have low values. This point is termed the crossover point and in catalyst technology serves for assessing different catalyst.

Figure 1:
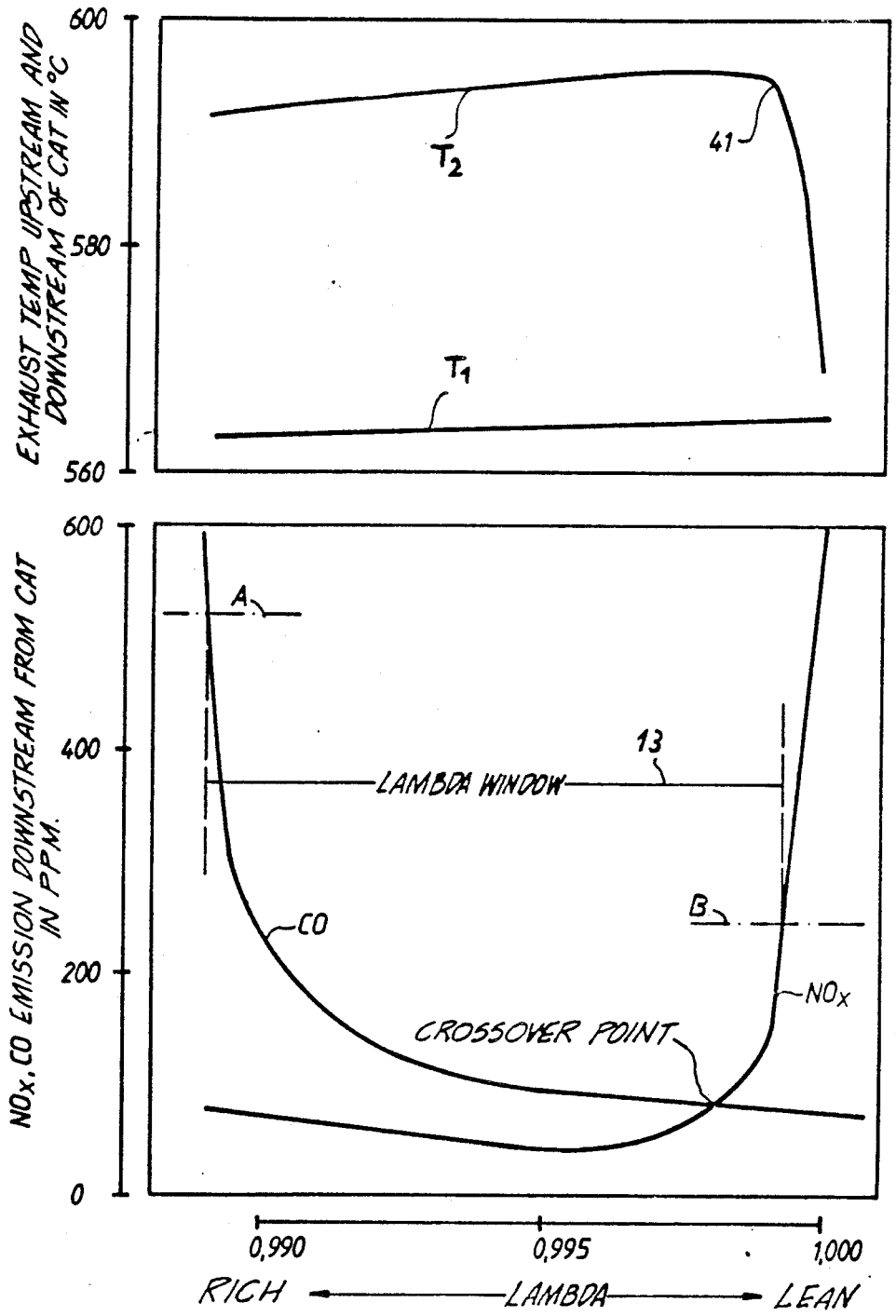
FIG. 1 shows graphs of the exhaust gas temperature as determined upstream and downstream from the catalyst and also graphs of the contaminant emission downstream from the catalyst as the function of the air/fuel ratio of the combusted mixture.

The upper half of FIG. 1 shows an upper curve produced by plotting the temperature $T_2$ at the (exothermically acting) catalyst against the air ratio lambda as well. This temperature $T_2$ undergoes a pronounced change at a bend point 41 at the lean limit of the lambda window 13. This fact is utilized in the invention in order to locate the lean limit of the lambda window 13 and for the readjustment of a lambda controller. Readadjustment is necessary owing to the change in the performance of a lambda probe with age, which is used as a sensor for measuring the actual value for control of the air/fuel ratio for IC engines. The second curve represents the exhaust gas temperature $T_1$ upstream from the catalyst, this being approximately independent of the air/fuel ratio lambda under constant load conditions.

Figure 2:
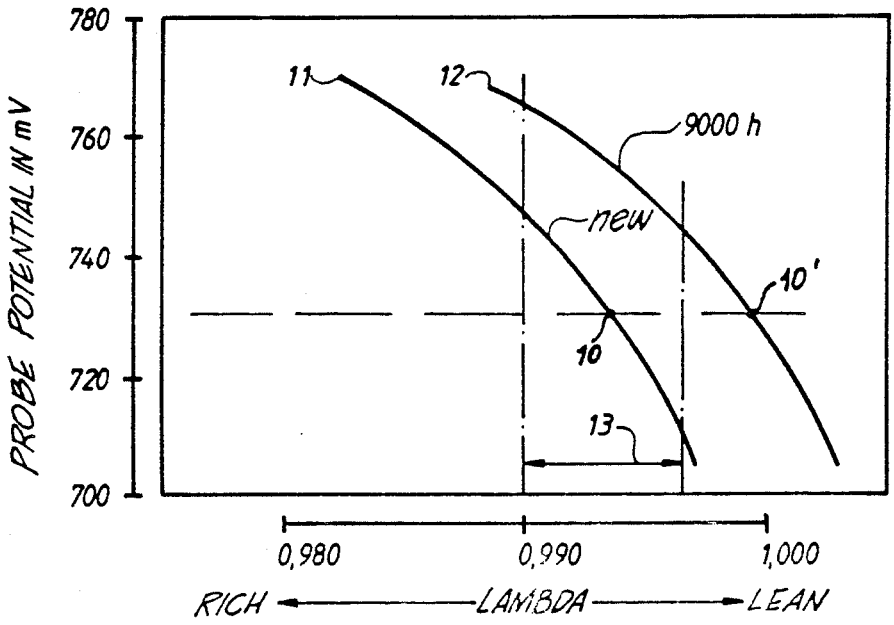
FIG. 2 is a graph in which the probe potential is plotted against the air/fuel ratio of the combusted mixture.

FIG. 2 shows the signal potentials of a lambda probe in its original condition (curve 11) and in curve 12 after operating for around 9,000 hours. Owing to this aging behavior of a lambda probe the control factor lambda is so affected that the operating point 10 is displaced towards the lean limit (operating point 10') of the lambda window 13. This may then lead exceeding to the limit B for the $NO_x$ contaminant.

Figure 3:
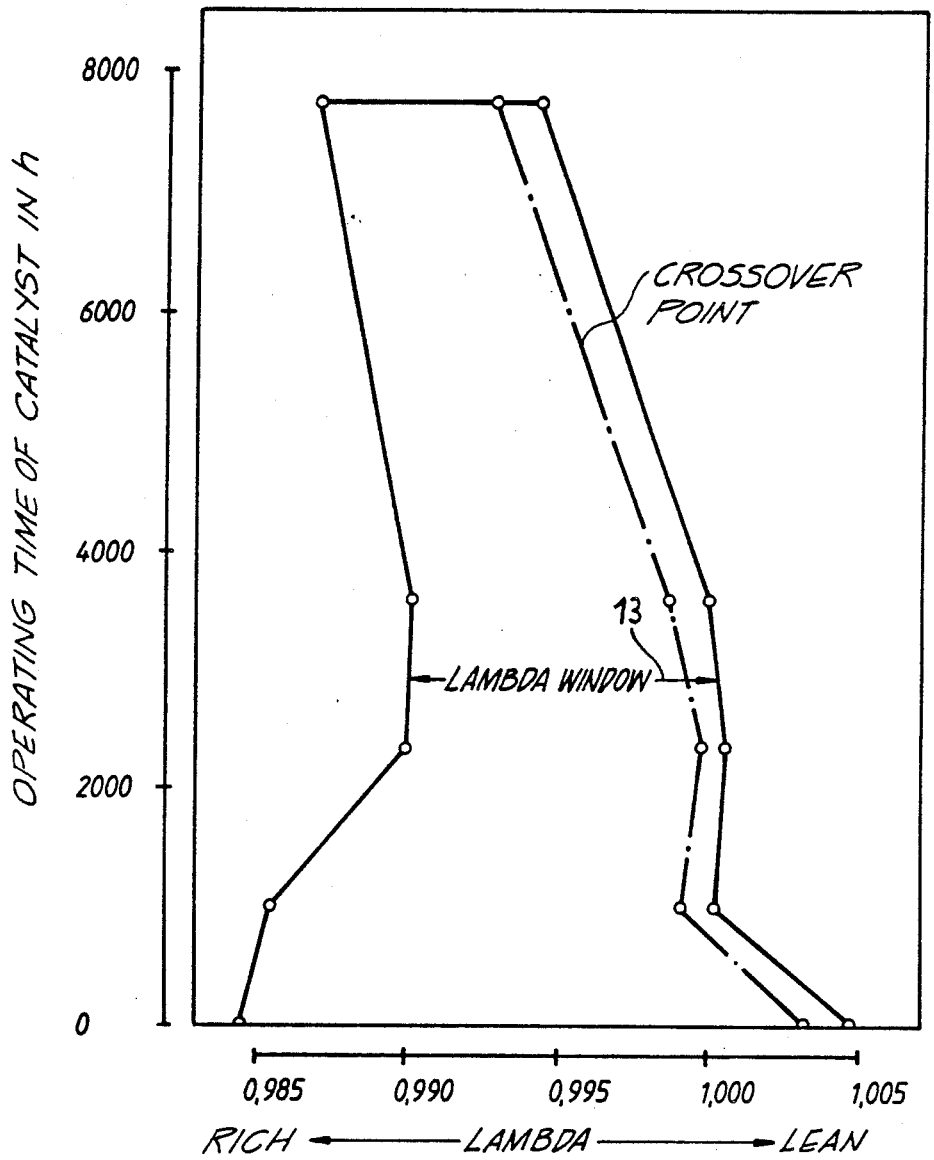
FIG. 3 shows graphs illustrating the aging behavior of a three-way catalyst.

A further factor affecting the diminution of contaminants in the overall system is the aging of the catalyst. FIG. 3 shows the change in the lambda window 13 and the crossover point of a three-way catalyst during the operating time under constant operating conditions. With an increase in the number of hours of operation the breadth of the lambda window 13 decreases, the most pronounced changes occurring at the lean limit of the lambda window inasmuch as there is a displacement towards rich. The crossover point drifts to the same degree. If the controller set point setting is not changed this may in some cases lead, in a manner similar to the change caused by aging of the lambda probe, to exceeding the $NO_x$ contaminant limit B.

Figure 4:
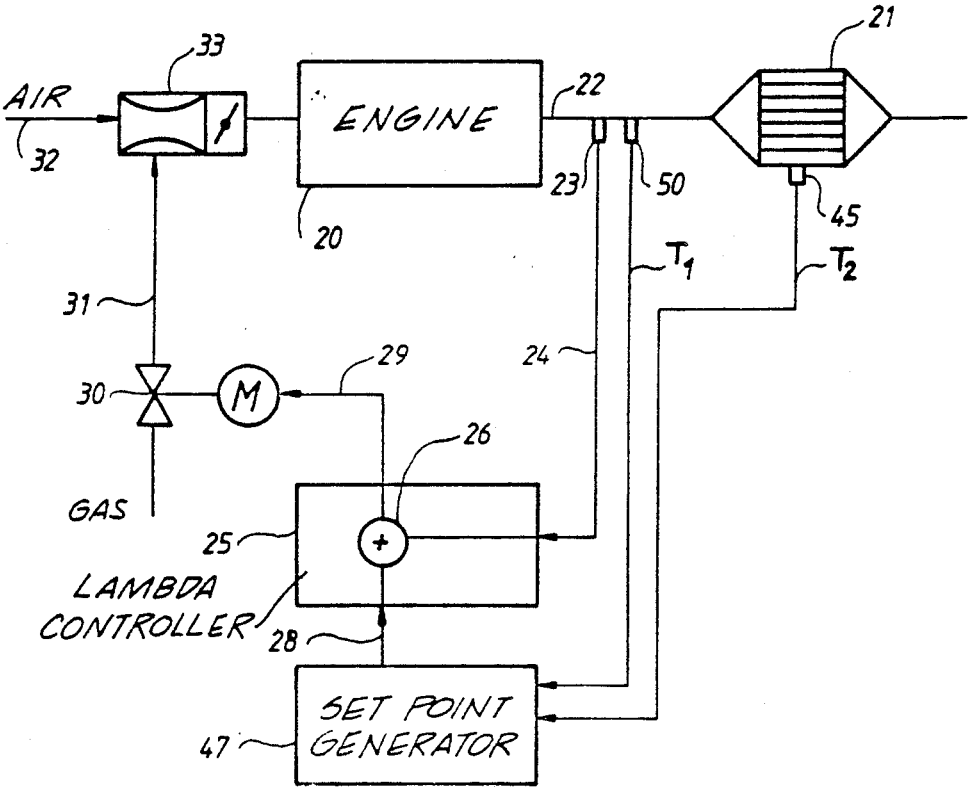
FIG. 4 diagrammatically shows a working embodiment of the invention.

These changes are to be allowed by the method and the apparatus in accordance with the invention, this now being described with reference to the embodiment shown in FIG. 4.

An IC engine such as for instance a four stroke gas engine 20 receives the flammable mixture via a gas and air mixer 33. The volumetric air to gas ratio is varied by a lambda controller 25 using a choke 30 in the gas pipe 31. A three-way catalyst 21 is placed in the exhaust gas pipe 22 of the engine 20 and within a certain operational range 13 of the air/fuel (denoted by the Greek letter lambda) decreases the amounts of the contaminants $NO_x$ and CO to such an extent that statutory or other desired limits A and B for contaminants may be observed. Maintaining operation within these limits is ensured with the aid of a lambda probe 23, which is fitted in the exhaust pipe 22 of the engine 20, and of a lambda controller 25. The lambda probe then provides an electrical signal 24 (referred to in what follows as the probe potential) dependent on the air/fuel ratio. This signal is supplied to the lambda controller 25, which is provided with the current set point 28 from a set point generator 47. After making a comparison between the actual and set values at 26 the lambda controller 25 delivers suitable setting signals 29 to the choke 30 in the gas pipe 31. The lambda probe 23 and the lambda controller 25 may be of conventional design.

In the exhaust pipe 22 temperatures sensors 50 and 45 are mounted upstream from and, respectively, at the catalyst 21, the temperature signals $T_1$ and $T_2$ being fed to the set point generator 47, which takes into account the temperatures $T_1$ and $T_2$ for producing the set point value 28 adjusted to be in accord with the current state of the system (as for instance to reflect the condition of the lambda probe, the catalyst etc.)

Figure 5:
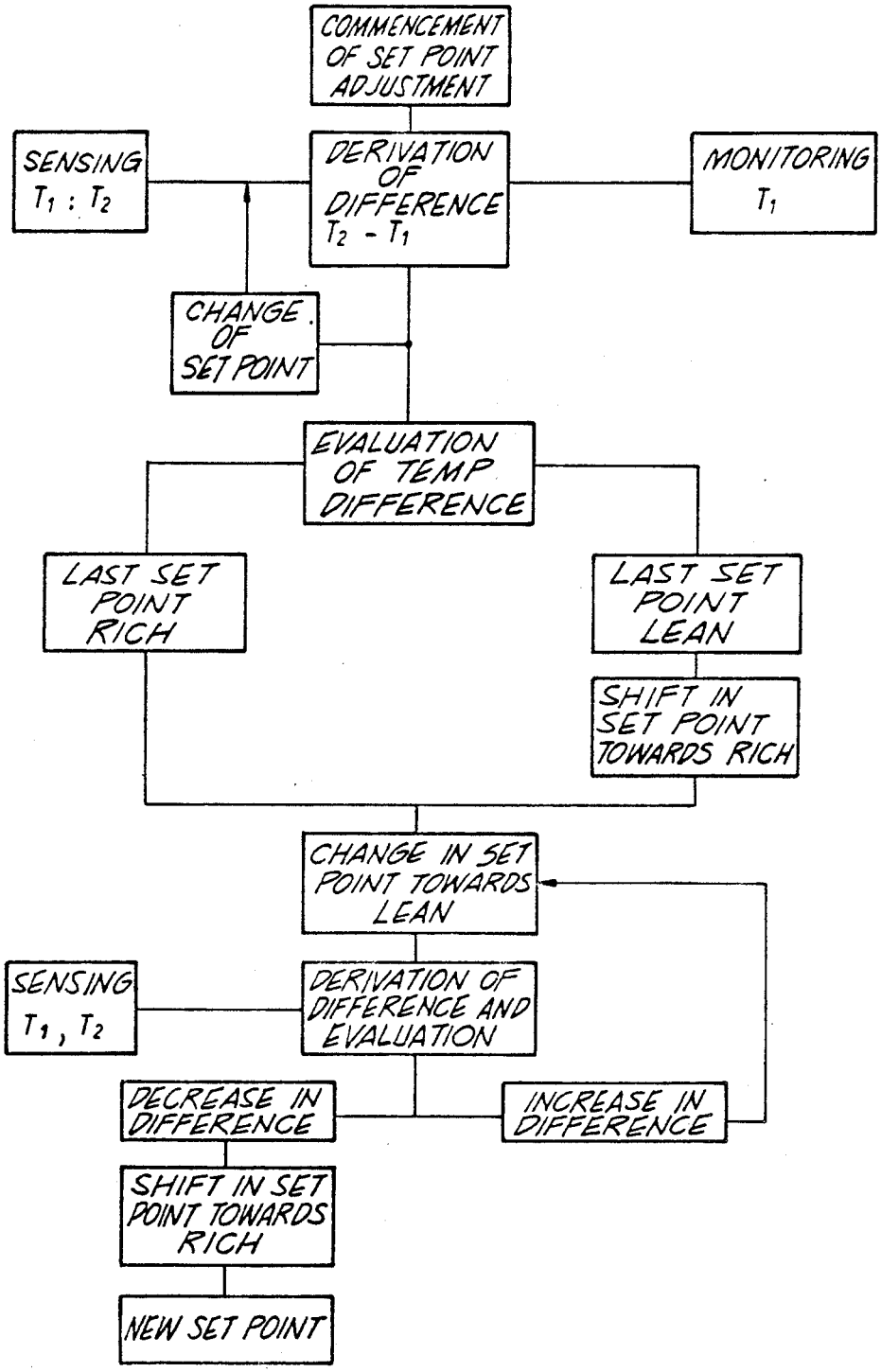
FIG. 5 shows a flow chart of the set point generator.

The manner of operation of the set point generator 47 will now be described with reference to FIG. 5, which represents the manner of deriving the set point 47.

After starting the adjustment process the temperatures $T_1$ and $T_2$ upstream and, in the other case, at or in the catalyst 21, are measured, while for the entire adjustment operation the exhaust gas temperture $T_1$ upstream from the catalyst 21 is monitored to see that it is constant. The adjustment process is to be performed while the engine 20 is operating under a constant load in order to avoid spurious adjustment.

The temperature difference is derived from the two temperatures $T_1$ and $T_2$. The bend 41 is to be ascertained with reference to the change in this temperature difference as a result of changing the lambda value. For this purpose the set point 28 is changed in the rich direction by the set point generator 47, the temperature difference being derived after each step.

Between the measurement of the temperatures and the previously detected air ratio a time is allowed to elapse until the temperatures have reached a steady state in the new operational condition.

On the basis of the temperature difference the set point generator 47 firstly determines the position of the last set point 28 in relation to the lean limit of the lambda window 13. If there has been a drop in the temperature difference, then the last set point will have been in the richer range. Should the set point generator 47 detect this condition, it will directly start the second phase of the adjustment process. If on the other hand there has been an increase in the temperature difference, the last set point will have been in the lean range, that is to say to the right of the bend 41 in FIG. 1. In this case the set point will be caused to move in the rich direction so that in any event the second phase will be commenced with a set point in the richer range. In this second phase the temperatures $T_1$ and $T_2$ upstream from and at the catalyst 21 are measured and their difference is derived and evaluated. As long as the temperature difference increases, the set point is changed step by step towards lean until a distinct decrease in the temperature difference is detected.

This set point is to be associated with the lean limit of the lambda window 13. Starting with this set point the set point is stepped in the rich direction (empirical value) so as to generate the new set point 28.

Normal operation of the IC engine 20 is continued with the new set point until a new adjustment process is commenced. This adjustment may be in response to the number of hours of operation. It is naturally also possible to cause an adjustment to take place by a manual control ad hoc.

The adjustment operation may also be performed on the basis of the temperature $T_2$ or of the catalyst alone. In this case there is no simultaneous monitoring of the constancy of operation.

What is claimed is:

1. A method of automatically controlling the air/fuel ratio of an IC engine having a catalyst, comprising producing a signal representative of air/fuel ratio of a combusted mixture by a lambda probe which samples exhaust gas from an IC engine upstream of the catalyst, measuring exhaust gas temperatures both upstream of the catalyst and after the exhaust gas has passed through at least a portion of the catalyst, determining in a lambda controller on the basis of the measured exhaust gas temperatures and the air/fuel ratio signal from the lambda probe a set point for controlling the air/fuel ratio of the engine, maintaining the engine at a constant load condition while the set point is determined, said determining of said set point being effected by varying the air/fuel ratio of the engine in steps which causes variation in the value of the exhaust gas temperature after the exhaust gas has traveled through at least a portion of said catalyst and establishing the value of the set point for an air/fuel ratio at which the temperature of the exhaust gas after passing through at least a portion of the catalyst is in a maximum temperature range.

2. The method as claimed in claim 1 wherein said varying of the air/fuel ratio results in changing the set point in steps, the value established for the set point being that at which the temperature of the exhaust gas, after passing through at least a portion of the catalyst, is a maximum.

3. The method as claimed in claim 1 wherein said varying of the air/fuel ratio results in changing the set point in steps, the method further comprising allowing a preset time to elapse after each change of the set point before measuring the temperature of the exhaust gas after its passage through at least a portion of the catalyst and comparing the thus measured temperature with the previous measured temperature for ascertaining the temperature changes as a function of the air/fuel ratio of the combusted mixture.

4. The method as claimed in claim 3 wherein the value of the set point is established to correspond to the formation of a bend in the curve of temperature of the exhaust gas after passage through at least a portion of the catalyst with respect to air/fuel ratio of the combusted mixture.

5. The method as claimed in claim 4 comprising changing the value of the set point as determined on the basis of said bend by an empirically predetermined amount as a new set point for further automatic control of the air/fuel ratio.

6. The method as claimed in claim 3 comprising changing the value of the set point as determined on the basis of the maximum temperature range by an empirically predetermined amount as a new set point for further automatic control of the air/fuel ratio.

7. The method as claimed in claim 1 wherein said maximum highest temperature range for the establishment of the value of the set point is determined by measuring the difference between the exhaust gas temperature after passage through at least a portion of the catalyst and the exhaust gas temperature upstream from the catalyst, and determining changes in the temperature difference as a function of the air/fuel ratio of the combusted mixture.

8. The method as claimed in claim 1 wherein the operation of the engine under constant load conditions is monitored by measuring the exhaust gas temperature measured upstream of the catalyst.

9. The method as claimed in claim 1 wherein the determination of said set point adjustment is performed at predetermined times.

* * * * *